US010118427B2

(12) United States Patent
Daudin et al.

(10) Patent No.: US 10,118,427 B2
(45) Date of Patent: Nov. 6, 2018

(54) THERMOSENSITIVE RECORDING MATERIALS CONTAINING CHELATING AGENTS

(71) Applicants: Laurence Daudin, Issenheim (FR); Florence Gayrard, Sainte-Croix-en-Plaine (FR); Daiki Iwata, Colmar (FR)

(72) Inventors: Laurence Daudin, Issenheim (FR); Florence Gayrard, Sainte-Croix-en-Plaine (FR); Daiki Iwata, Colmar (FR)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/448,840

(22) Filed: Mar. 3, 2017

(65) Prior Publication Data

US 2017/0267008 A1 Sep. 21, 2017

(30) Foreign Application Priority Data

Mar. 17, 2016 (EP) ..... 16305295

(51) Int. Cl.

| | |
|---|---|
| ***B41M 5/337*** | (2006.01) |
| ***B41M 5/50*** | (2006.01) |
| ***B41M 5/26*** | (2006.01) |
| ***B41M 5/42*** | (2006.01) |
| *B41M 5/323* | (2006.01) |
| *B41M 5/327* | (2006.01) |

(52) U.S. Cl.

CPC ..... *B41M 5/506* (2013.01); *B41M 5/26* (2013.01); *B41M 5/3375* (2013.01); *B41M 5/42* (2013.01); *B41M 5/423* (2013.01); *B41M 5/323* (2013.01); *B41M 5/3275* (2013.01); *B41M 2205/04* (2013.01); *B41M 2205/38* (2013.01); *B41M 2205/40* (2013.01)

(58) Field of Classification Search

CPC ..... B41M 5/26; B41M 5/337; B41M 5/3375; B41M 5/42; B41M 5/423

USPC ..... 503/200

See application file for complete search history.

(56) References Cited

U.S. PATENT DOCUMENTS

| | | | |
|---|---|---|---|
| 3,442,682 | A | 5/1969 | Fukawa et al. |
| 4,997,806 | A | 3/1991 | Torii |
| 5,130,291 | A | 7/1992 | Okuda |

(Continued)

FOREIGN PATENT DOCUMENTS

| | | | |
|---|---|---|---|
| EP | 2404764 | A1 | 1/2012 |
| EP | 2716466 | A1 | 4/2014 |

(Continued)

OTHER PUBLICATIONS

The partial European search report dated Oct. 5, 2016.
The extended European search report dated Jan. 4, 2017.

*Primary Examiner* — Bruce H Hess
(74) *Attorney, Agent, or Firm* — Cooper & Dunham LLP

(57) ABSTRACT

The present invention relates to thermal recording materials comprising (in order):

a support (base) layer;
one or more "undercoat" layers;
a thermal layer (thermosensitive coloring layer); and
one or more "protective" layers,
wherein the thermal recording material contains an aminocarboxylic and/or phosphorus-based chelating agent.

The thermal (thermosensitive) recording materials of the invention show enhanced plasticizer resistance and/or pre-print uniformity.

10 Claims, 1 Drawing Sheet

(56) References Cited

U.S. PATENT DOCUMENTS

| | | | |
|---|---|---|---|
| 2010/0069240 | A1 | 3/2010 | Ikezawa |
| 2010/0279079 | A1 | 11/2010 | Campbell et al. |

FOREIGN PATENT DOCUMENTS

| | | | |
|---|---|---|---|
| EP | 2722190 | A1 | 4/2014 |
| EP | 2829409 | A1 | 1/2015 |
| JP | S54-128347 | | 10/1979 |
| JP | S56-125354 | U | 9/1981 |
| JP | S57-137188 | | 8/1982 |
| JP | S57-188392 | | 11/1982 |
| JP | S59-011288 | | 1/1984 |
| JP | H08-282100 | | 10/1996 |
| JP | 2015-086352 | | 5/2015 |
| JP | 2015-134425 | | 7/2015 |

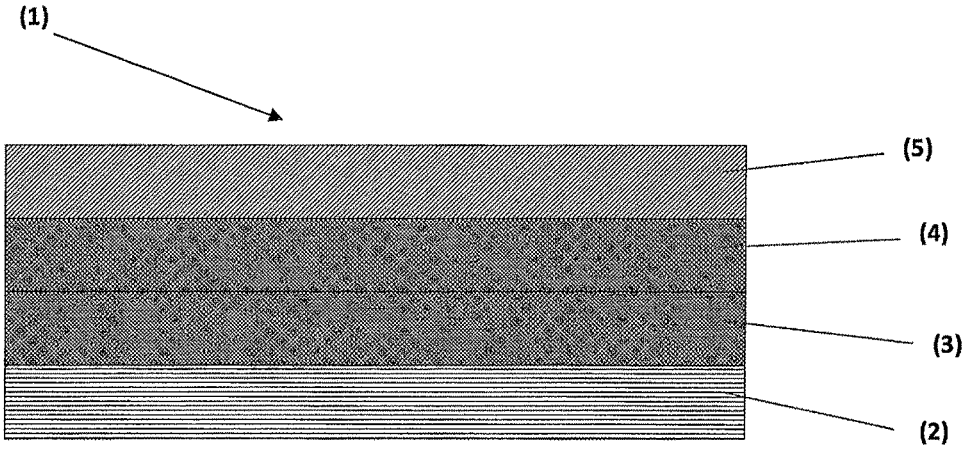
(1)
(5)
(4)
(3)
(2)

THERMOSENSITIVE RECORDING MATERIALS CONTAINING CHELATING AGENTS

CROSS-REFERENCE TO RELATED APPLICATIONS

The present application claims priority under 35 U.S.C. § 119 of European Patent Application No. 16305295.4 filed on Mar. 17, 2016, the entire contents of which are hereby incorporated by reference.

FIELD OF THE INVENTION

The present invention relates to a thermal (thermosensitive) recording material and an image forming method using the same.

TECHNICAL BACKGROUND TO THE INVENTION

Thermosensitive recording materials are known which use a colorant system wherein a dye, such as a leuco dye, in one layer of the material reacts, upon the application of heat, with another component, a so-called "developer" in order to give rise to a coloured product.

In a typical thermosensitive recording material layer assembly, the following layers are present, constructed in the following order:

- a support (base) layer is provided e.g. a paper support;
- on top of the support (base) layer, there may optionally be one or more "undercoat" layers which do not contain the (dye+developer) couple;
- on top of the support (base) layer, or on top of the uppermost undercoat layer if one or more undercoat layers is/are present, is the thermal layer (thermosensitive coloring layer) containing the (dye+developer) couple; and
- on top of the thermosensitive coloring layer, there may be one or more "protective" layers. The protective layer or layers separate(s) the thermosensitive coloring layer from the outside environment and the uppermost "protective" layer is, like the lowermost support (base) layer (unless the latter has itself a backing layer), in contact with the outside environment.

FIG. 1 shows an illustrative, non-limiting example of a thermosensitive recording material layer assembly (1). In this example, on top of the support (base) layer (2) there is a single undercoat layer (3). Following this there is a thermosensitive coloring layer (4), followed by a protective layer (5). In other known embodiments, two (or more) protective layers may be present, which may be numbered (51, 52, . . . ).

Thermosensitive recording materials are in common daily use, for example, in the transport industry for train, aeroplane and city underground railway tickets. They are also used in other ticketing applications such as parking, museum, cinema and concert tickets, as well as for displaying information on industrially prepared perishable foods, and also for facsimile machines. As a consequence, many types of resistance, for example resistance against plasticizers, water, heat, oil and light have been the subject of continuous attempts to improve thermosensitive recording materials.

Among such improvements, it has been proposed to provide a protective layer by coating at the surface of a heat-sensitive color-forming layer with an aqueous emulsion of a resin having a film-forming capability and resistance to chemicals (Japanese published patent application JP-54-128347) or a water-soluble high-molecular weight compound such as polyvinyl alcohol (Japanese utility model published application 56-125354). These methods are capable to prevent the color formation in non-image areas or fading in image areas even if the heat-sensitive recording paper is placed in contact with overwrap films or exposed to oils.

However, for the protective layer using such a water-soluble resin, in many cases the water resistance is absent, and a commonly used method (JP 57-188392) is to cure the protective layer used in combination with a cross-linking agent. Specific examples of the crosslinking agent (the curing agent) are polyepichlorohydrin, glyoxal, glutaric aldehyde, melamine compounds, polyamide-polyurea resin, aziridine compounds, zirconium compounds and boric acid.

EP 2 829 409 proposes to improve properties such as plasticizer resistance through the use of a specific developer combination, a mixture of 2,4'- and 4,4'-dihydroxyphenylsulfone, the 2,4'-isomer being the major component.

JP-2015-086352 addresses the issue of instability of cross-linked polyvinyl alcohol (PVA). It was known to add cross-linking agents to increase water-resistance of PVA. Known organic cross-linking agents includes aldehydes (e.g. formaldehyde, glyoxal, glutardialdehyde, glyoxylic acid and salts thereof), epoxy compounds, amino resins (e.g. urea resin, guanamine resin, melamine resin), amine compounds (e.g. ethylenediamine, hexamethylenediamine, meta-xylenediamine, 1,3-bisaminocyclohexane), hydrazine compounds, hydrazide compounds (e.g. adipic acid dihydrazide, carbodihydrazide, polyhydrazide), polyvalent carboxylic acids, polyoxyalkylene diamines or polyamines, acid anhydrides, polyisocyanates, block isocyanates. Known inorganic cross-linking agents include boric acid, borate salts (e.g. borax), zirconium compounds, titanium compounds (e.g. tetraalkoxy titanate), silicon compounds which have reactive functional groups, aluminium compounds (e.g. aluminum sulfate, an aluminium chloride, an aluminium nitrate, etc.), phosphorus compounds. However, cross-linked polyvinyl alcohol (PVA) was known to be potentially subject to yellowing over time. The authors of JP-2015-086352 found that certain chelating agents could reduce this yellowing effect. In particular, experiments were performed to investigate the effect of ethyelenediamine tetraacetic acid (EDTA) and some related polyamino-polycarboxylic acid chelating agents on the color stability over time of films prepared from coating liquids prepared from. PVA with adipic acid dihydrazide added as cross-linking agent. It is described that the resin composite layer containing PVA, cross-linking agent and chelating agent can be used as a protective layer for a thermal recording material, but multi-layer thermal recording materials are not prepared experimentally, and no test of plasticizer resistance of such a multi-layer thermal recording materials is carried out.

JP-H08-282100 proposes adding epoxy compound to the thermal recording layer of a thermal recording material in order to improve preservability of a recording image. However, this generates colouring of the background. As a countermeasure, EDTA is added as an inhibitor of colour development. U.S. Pat. No. 3,442,682 describes the use of a chelating agent such as EDTA in the thermosensitive layer as inhibitor of color development, with a dye which is not a leuco dye.

SUMMARY OF THE INVENTION

An object of the present invention is to provide a thermal (thermosensitive) recording material showing enhanced plasticizer resistance and/or preprint uniformity. It has been found that these effects can be achieved through the use of chelating agents.

Chelating agents such as aminocarboxylic acid chelating agents, most preferably (mono)amino-polycarboxylic acid chelating agents whose molecular structure contains one amino group and two or more carboxylic acid groups, have notably been found to have positive effects on plasticizer resistance.

In a first aspect of the invention, one or more of the protective layer(s) and/or said thermosensitive layer of the thermal recording material contains a chelating agent whose structure is given by following general formula (1):

(1)

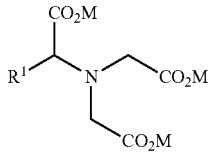

wherein $R^1$ is a linear alkyl group of 1 to 8 carbon atoms, optionally substituted with one or more carboxyl groups —$CO_2M$, wherein M is hydrogen, ammonium or substituted ammonium, alkali metal, alkaline earth metal or a combination thereof.

In a second aspect of the invention, one or more of the undercoat layer(s) of the thermal, recording material contains an aminocarboxylic acid chelating agent. Most preferred chelating agents include those of above general formula (1).

In the third aspect of the invention, one or more of the said undercoat layer(s) and/or the thermo-sensitive coloring layer and/or one or more of the said protective layer(s) contains a phosphorus-based chelating agent chosen from one of the following families:

(1) aminophosphates and amino phosphonic acids;
(2) phosphates, pyrophosphates and polyphosphates;
(3) diphosphonic acids containing C—OH groups;
(4) phosphonotricarboxylic acids; and
(5) polyol phosphate esters.

Generally the preferred amount of any type of chelating agent among those given above (aminocarboxylic acid or phosphorus-based), in terms of dry mass, is comprised between 0.005 g/$m^2$ and 0.5 g/$m^2$ (with respect to the whole thermal recording material assembly). A preferred amount is at least 0.03 g/$m^2$ and at most 0.35 g/$m^2$ of thermal recording material.

In the present invention, it is possible to use simultaneously an aminocarboxylic acid chleating agent as set out above, as well as a phosphorus-based chelating agent, in the same thermal recording material assembly.

At the present time, it is not yet fully clear why chelating agents in the thermal recording material have positive effects on plasticizer resistance and/or preprint uniformity. Without wishing to be bound by any particular theory, the inventors believe that chelating agents may function by trapping phthalates like DOP or DEHP commonly present in plasticizers and thus prevent unfavourable interaction of phthalate with the dye-developer couple. Aminocarboxylic acid chelating agents in particular appear to have positive effects on plasticizer resistance.

In parallel, it is possible that chelating agents, for example phosphorus-based chelating agents according to the research carried out by the present inventors, may have an effect on preprint uniformity through the following possible mechanism: metal cations such as $Ca^{2+}$ present notably as inorganic filler substances in the paper base layer or other layers may migrate and form hydrophobic deposits with anions having hydrophobic chains, for example fatty acid carboxylates such as stearate. Salts of such anions with hydrophobic chains may be used as lubricants, for example, or hot-meltable materials in the thermosensitive coloring layer. The hydrophobic deposits may deteriorate properties such as preprint uniformity. The chelating agent may function by trapping metal cations such as $Ca^{2+}$ and preventing precipitation of hydrophobic metal salts (such as calcium salts of fatty acids). The present invention may therefore find particular application when metal cations such as (but not limited to) $Ca^{2+}$ and anions with hydrophobic chains such as fatty acids are present. It is emphasized however, that this only one possible theoretical mechanism under investigation. Other causes of chelating agent effect are possible and the invention is not restricted to thermal recording materials with any specific components.

BRIEF SUMMARY OF THE FIGURES

FIG. 1 is a schematic representation of an illustrative, non-limiting example of a thermosensitive recording material layer assembly.

DETAILED DESCRIPTION OF THE INVENTION

As mentioned above, it is an object of the present invention, in its different aspects, to provide a thermal (thermosensitive) recording material showing enhanced plasticizer resistance and/or preprint uniformity. It has been found that these effects can be achieved through the use of chelating agents, such as aminocarboxylic acid chelating agents, most preferably (mono)amino-polycarboxylic acid chelating agents whose molecular structure contains one amino group and two or more carboxylic acid groups. Such a role, notably in providing enhanced plasticizer resistance was not reported in the prior art for such chelating agents.

Preferred chelating agents in the present invention are (mono)amino-polycarboxylic acid chelating agents whose molecular structure contains one amino group and two or more carboxylic acid groups.

Preferred aminocarboxylic chelating agents in the present invention are ones containing —N—$CH_2$—$CH_2$—N— groups and/or —N—$CH_2$—$CO_2M$ groups, wherein in —$CO_2M$, M is hydrogen, ammonium or substituted ammonium, alkali metal, alkaline earth metal or a combination thereof.

Alkali metals in this context are Li, Na, K, Rb and Cs (as cations), most notably $Na^+$ and $K^+$ salts. Alkaline earth metals in this context include Mg, Ca, Sr and Ba (as cations), most notably $Mg^{2+}$ and $Ca^{2+}$ salts. Substituted ammonium salts include $NH_4^+$ wherein one or more of the H atoms on the N atom have been replaced by a linear alkyl group, a cycloalkyl group or an aryl group, preferably having 10 carbons or less, more preferably 6 carbons or less for linear alkyl groups or cycloalkyl groups.

A preferred class of chelating agent in the present invention is one whose structure is given by following general formula (1):

(1)

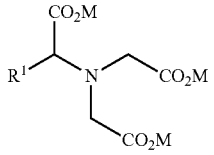

wherein $R^1$ is a linear alkyl group of 1 to 8 carbon atoms, optionally substituted with one or more carboxyl groups —$CO_2M$, wherein M is hydrogen, ammonium or substituted ammonium, alkali metal, alkaline earth metal or a combination thereof, preferred M groups being as defined above.

Two most preferred chelating agents in the present invention are:

methylglycine diacetic acid (MGDA) or salts thereof, having $R^1$=—$CH_3$; and glutamic diacetic acid (GLDA) or salts thereof, having $R^1$=—$(CH_2)_2$—$CO_2M$.

Other advantageous chelating agents in some embodiments of the invention include:

ethylenediamine tetraacetic acid (EDTA) or salts thereof; and hydroxyethylendiamine triacetic acid (HEDTA) or salts thereof.

Preferred salts here include in particular ammonium or substituted ammonium, alkali metal or alkaline earth metal salts as defined above.

In the present invention, where a phosphorus-based chelating agent is used, chosen from the family (1) comprising aminophosphates and amino phosphonic acids, preferred examples include ATMP (amino trimethylene phosphonic acid), EDTMP (ethylene diamino tetramethylene phosphonic acid), DTPMP (diethylenetriamine penta(methylene phosphonic acid)), HMDTMPA (hexamethylenediamine tetramethylene phosphonic acid), nitriliotri(methylene phosphonic acid) NTMP, iminodi(methylenephosphonic acid) (IDMP). Salts of these chelating agents, such as sodium or potassium salts, or ammonium or substituted ammonium salts as defined above, may also be used.

In the present invention, where a phosphorus-based chelating agent is used, chosen from the family (2) comprising phosphates, pyrophosphates and polyphosphates, preferred examples include: trisodium phosphate, STMP (sodium trimetaphosphate), STPP (sodiumtripolyphosphate), and TSPP (tetrasodium pyrophosphate). Potassium salts of these species, or ammonium or substituted ammonium salts as defined above, may also be used.

In the present invention, where a phosphorus-based chelating agent is used, chosen from the family (3) diphosphonic acids containing C—OH groups, preferred examples include 1-hydroxyethane 1,1-diphosphonic acid (HEDP). Salts of these chelating agents, such as sodium or potassium salts, or ammonium or substituted ammonium salts as defined above, may also be used.

In the present invention, where a phosphorus-based chelating agent is used, chosen from the family (4) phosphonotricarboxylic acids, preferred examples include phosphonobutane-tricarboxylic acid (PBTC). Salts of these chelating agents, such as sodium or potassium salts, or ammonium or substituted ammonium salts as defined above, may also be used.

In the present invention, where a phosphorus-based chelating agent is used, chosen from the family (5) polyol phosphate esters, preferred examples include polyhydric alcohol phosphate ester (PAPE).

Base (Support) Layer

The support is suitably selected depending on the intended purpose without any restriction. As the support, any of supports made of wood-free paper, recycled pulp (containing 50% or more of recycled pulp), synthetic paper, polyethylene films, and laminated paper, etc. may be used. Acid paper may be free of basic inorganic fillers such as calcium carbonate, but calcium carbonate is often present in paper made in acid-free manufacturing processes.

Undercoat Layer(s)

There may be a single undercoat layer or the undercoat may be formed of two or more layers. The undercoat layer(s) contain(s) at least an aqueous polymer emulsion, and/or a water-soluble resin.

In preferred embodiments for undercoat layers of the thermal recording materials of the present invention, the aqueous polymer emulsion is appropriately selected depending on the intended purpose without any limitation, and examples thereof include: latex, such as an acrylic resin, a modified acrylic resin (e.g., an acrylic resin containing a carboxyl group), a styrene-butadiene copolymer, and a styrene-butadiene-acryl-based copolymer, and emulsions such as a vinyl acetate resin, a vinyl acetate-acrylic acid copolymer, a styrene-acrylic acid ester copolymer, an acrylic acid ester resin, and a polyurethane resin. These may be used alone, or in combination. Among them, a styrene-butadiene copolymer is particularly preferable.

In preferred formulations, the percentage of dry mass constituted by the polymer material of the polymer emulsion in an undercoat layer is between 10% and 90% of the dry undercoat layer as a whole, more preferably between 30% to 70%, still more preferably between 35% and 60%.

If a water-soluble resin is used, this is suitably selected depending on the intended purpose without any particular restriction. Examples thereof include polyvinyl alcohol, modified polyvinyl alcohol, starch and derivatives thereof, cellulose derivatives such as methoxy cellulose, hydroxy ethyl cellulose, carboxy methyl cellulose, methyl cellulose and ethyl cellulose, polyacrylate soda, polyvinyl pyrrolidone, acryl amide-acrylate copolymers, acryl amide-acrylate-methacrylic acid terpolymers, alkali salts of styrene-maleic anhydride copolymers, alkali salts of isobutylene-maleic anhydride copolymers, polyacrylamide, modified polyacrylamide, methyl vinyl ether-maleic anhydride copolymers, carboxyl-modified polyethylene, polyvinyl alcohol-acryl amide block copolymers, melamine-formaldehyde resin, urea-formaldehyde resin, alginate soda, gelatin and casein. These may be used alone or in combination.

The undercoat layer is formed by applying a water dispersion of the water-soluble resin and followed by drying. As the components added to the water dispersion and contained in the first undercoat layer, an inorganic filler, hollow particles, and further other components, may be used. Particularly, when an image is formed by using a thermal head, hollow particles are preferably used in order to improve the coloring sensitivity and fineness.

The amount of the water-soluble resin in the undercoat layer is suitably selected depending on the intended purpose without any restriction. In the present invention, in preferred embodiments, the dry mass of water-soluble resin is not more than 20% with respect to the dry mass of the undercoat layer as a whole, preferably not more than 10%, and if used more preferably between 5% and 10%, here in combination with a polymer forming an aqueous emulsion.

An inorganic filler may be used or may be omitted from the undercoat layer(s). If an inorganic filler is used, examples thereof include aluminum hydroxide, calcium carbonate, aluminum oxide, zinc oxide, titanium dioxide, silica, barium sulfate, talc, kaolin, alumina and clay. These may be used alone or in combination. Among these, aluminum hydroxide, calcium carbonate, kaolin and clay are preferable in terms of liquid properties in a coating liquid, stability of dispersed particles, and water solubility.

As components added to the water dispersion and contained in the undercoat layer, hollow particles may advantageously be used. Such hollow particles preferably have a hollow ratio of 50% or more. Some preferred hollow particles may have a higher hollow ratio of 80% or more, more preferably 90% or more, wherein the hollow ratio (in %) is the (inner diameter of a hollow particle/outer diameter of the hollow particle)×100.

Each of the hollow particles may appropriately have a shell made of a thermoplastic resin and contain therein air or other gas. They are advantageously fine hollow particles already in a foamed state, and those having a volume average particle diameter of 2 μm to 10 μm are advantageously used. Fine hollow particles with a volume average particle diameter of approximately 1 μm or 1.5 μm can also be used. In one preferred embodiment, a combination may be used of 1) hollow particles with a volume average particle diameter of 2 μm to 10 μm with a hollow ratio of 80% or more, and 2) hollow particles with a volume average particle diameter of more than 0.5 μm to less than 2 μm having a hollow ratio of from more than 50% to less than 80%.

The hollow particles are advantageously particles each having a thermoplastic resin as a shell, and examples of the thermoplastic resin include polystyrene, polyvinyl chloride, polyvinylidene chloride, polyvinyl acetate, polyacrylic ester, polyacrylonitrile, and polybutadiene, and copolymer resins thereof. Among these, the copolymer resins which contain vinylidene chloride and acrylonitrile as main constituents are particularly preferable.

The amount of the hollow particles after the undercoat (i.e. the undercoat layer or layers) is dried is preferably 0.2 g or more, more preferably 0.4 g to 5 g, per square meter of the support.

The deposition amount of a first undercoat layer in the thermosensitive recording material is suitably selected depending on the intended purpose without any restriction. It is preferably 0.4 $g/m^2$ to 10 $g/m^2$, more preferably 0.6 $g/m^2$ to 7 $g/m^2$.

Thermosensitive Coloring Layer

The thermosensitive coloring layer contains a colorant system wherein a dye, such as a leuco dye, in one layer of the material reacts, upon the application of heat, with another component, a so-called "developer" in order to give rise to a coloured product.

The leuco dye is a compound exhibiting electron donation properties, and may be used singly or in combination of two or more species. However, the leuco dye itself is a colorless or light-colored dye precursor, and commonly known leuco compounds can be used. Examples of the leuco compounds include triphenylmethane phthalide compounds, triarylmethane compounds, fluoran compounds, phenothiazine compounds, thiofluoran compounds, xanthen compounds, indophthalyl compounds, spiropyran compounds, azaphthalide compounds, chlormenopirazole compounds, methyne compounds, rhodamine anilinolactum compounds, rhodamine lactum compounds, quinazoline compounds, diazaxanthen compounds, bislactone compounds. In consideration of coloring property, fogging of the background, and color fading of the image due to moisture, heat or light radiation, specific examples of such compounds are as follows. 2-anilino-3-methyl-6-diethyl amino fluoran, 2-anilino-3-methyl-6-(di-n-butyl amino) fluoran, 2-anilino-3-methyl-6-(di-n-pentyl amino) fluoran, 2-anilino-3-methyl-6-(N-n-propyl-N-methyl amino) fluoran, 2-anilino-3-methyl-6-(N-isopropyl-N-methyl amino) fluoran, 2-anilino-3-methyl-6-(N-isobutyl-N-methyl amino) fluoran, 2-anilino-3-methyl-6-(N-n-amyl-N-methyl amino) fluoran, 2-anilino-3-methyl-6-(N-sec-butyl-N-ethyl amino) fluoran, 2-anilino-3-methyl-6-(N-n-amyl-N-ethyl amino) fluoran, 2-anilino-3-methyl-6-(N-iso-amyl-N-ethyl amino) fluoran, 2-anilino-3-methyl-6-(N-cyclohexyl-N-methyl amino) fluoran, 2-anilino-3-methyl-6-(N-ethyl-p-toluidino) fluoran, 2-anilino-3-methyl-6-(N-methyl-p-toluidino) fluoran, 2-(m-trichloro methyl anilino)-3-methyl-6-diethyl amino fluoran, 2-(m-trifluoro methyl anilino)-3-methyl-6-diethyl amino fluoran, 2-(m-trifluoro methyl anilino)-3-methyl-6-(N-cyclohexyl-N-methyl amino) fluoran, 2-(2,4-dimethyl anilino)-3-methyl-6-diethyl amino fluoran, 2-(N-ethyl-p-toluidino)-3-methyl-6-(N-ethyl anilino) fluoran, 2-(N-methyl-p-toluidino)-3-methyl-6-(N-propyl-p-toluidino) fluoran, 2-anilino-6-(N-n-hexyl-N-ethyl amino) fluoran, 2-(o-chloranilino)-6-diethyl amino fluoran, 2-(o-bromoanihno)-6-diethyl amino fluoran, 2-(o-chloranilino)-6-dibutyl amino fluoran, 2-(o-fluoroanilino)-6-dibutyl amino fluoran, 2-(m-trifluoro methyl anilino)-6-diethylamino fluoran, 2-(p-acetyl anilino)-6-(N-n-amyl-N-n-butyl amino) fluoran, 2-benzyl amino-6-(N-ethyl-p-toluidino) fluoran, 2-benzyl amino-6-(N-methyl-2,4-dimethyl anilino) fluoran, 2-benzyl amino-6-(N-ethyl-2,4-dimethyl anilino) fluoran, 2-dibenzyl amino-6-(N-methyl-p-toluidino) fluoran, 2-dibenzyl amino-6-(N-ethyl-p-toluidino) fluoran, 2-(di-p-methyl benzyl amino)-6-(N-ethyl-p-toluidino) fluoran, 2-([alpha]-phenyl ethyl amino)-6-(N-ethyl-p-toluidino) fluoran, 2-methyl amino-6-(N-methyl anilino) fluoran, 2-methyl amino-6-(N-ethyl anilino) fluoran, 2-methyl amino-6-(N-propyl anilino) fluoran, 2-ethyl amino-6-(N-methyl-p-toluidino) fluoran, 2-methyl amino-6-(N-methyl-2,4-dimethyl anilino) fluoran, 2-ethyl amino-6-(N-methyl-2,4-dimethyl anilino) fluoran, 2-dimethyl amino-6-(N-methyl anilino) fluoran, 2-dimethyl amino-6-(N-ethyl anilino) fluoran, 2-diethyl amino-6-(N-methyl-p-toluidino) fluoran, benzo leuco methylene blue, 2-[3,6-bis(diethyl amino)]-6-(o-chloranilino) xanthyl benzoic acid lactum, 2-[3,6-bis(diethyl amino)]-9-(o-chloranilino) xanthyl benzoic acid lactum, 3,3-bis(p-dimethyl amino phenyl) phtahlide, 3,3-bis(p-dimethyl amino phenyl)-6-dimethyl amino phthalide, 3,3-bis(p-dimethyl amino phenyl)-6-diethyl amino phthalide, 3,3-bis(p-dimethyl amino phenyl)-6-chlorphthalide, 3,3-bis(p-dibutyl amino phenyl) phthalide, 3-(2-methoxy-4-dimethyl amino phenyl)-3-(2-hydroxy-4,5-dichlorophenyl) phthalide, 3-(2-hydroxy-4-dimethyl amino phenyl)-3-(2-methoxy-5-chlorophenyl) phthalide, 3-(2-hydroxy-4-dimethoxy amino phenyl)-3-(2-methoxy-5-chlorophenyl) phthalide, 3-(2-hydroxy-4-dimethoxy amino phenyl)-3-(2-methoxy-5-nitrophenyl) phthalide, 3-(2-hydroxy-4-diethyl amino phenyl)-3-(2-methoxy-5-methyl phenyl) phthalide, 3,6-bis(dimethyl amino) fluorenespiro (9,3')-6'-dimethyl amino phthalide, 6'-chloro-8'-methoxy-benzoindolino spiropyran, and 6'-bromo-2'-methoxy benzoindolino spiropyran. These may be used alone or in combination.

The amount of the leuco dye contained in the thermosensitive coloring layer is preferably 5% by mass to 20% by mass, more preferably 10% by mass to 25% by mass.

As the developer, various electron accepting materials are suitably used to react with the aforementioned leuco dye at the time of heating so as to develop colors. Examples thereof include phenolic compounds, organic or inorganic acidic compounds and esters or salts thereof. Specific examples thereof include bisphenol A, tetrabromobisphenol A, gallic acid, salicylic acid, 3-isopropyl salicylate, 3-cyclohexyl salicylate, 3-5-di-tert-butyl salicylate, 3,5-di-[alpha]-methyl benzyl salicylate, 4,4'-isopropylidenediphenol, 1,1'-isopropylidene bis (2-chlorophenol), 4,4'-isopropylidene bis (2,6-dibromophenol), 4,4'-isopropylidene bis (2,6-dichlorophenol), 4,4'-isopropylidene bis (2-methyl phenol), 4,4'-isopropylidene bis (2,6-dimethyl phenol), 4,4'-isopropylidene bis (2-tert-butyl phenol), 4,4'-sec-butylidene diphenol, 4,4'-cyclohexylidene bisphenol, 4,4'-cyclohexylidene bis (2-methyl phenol), 4-tert-butyl phenol, 4-phenyl phenol, 4-hydroxy diphenoxide, α-naphthol, β-naphthol, 3,5-xylenol, thymol, methyl-4-hydroxybenzoate, 4-hydroxyacetophenone, novolak phenol resins, 2,2'-thio bis (4,6-dichloro phenol), catechol, resorcin, hydroquinone, pyrogallol, fluoroglycine, fluoroglycine carboxylate, 4-tert-octyl catechol, 2,2'-methylene bis (4-chlorophenol), 2,2'-methylene bis (4-methyl-6-tert-butyl phenol), 2,2'-dihydroxy diphenyl, ethyl p-hydroxybenzoate, propyl p-hydroxybenzoate, butyl p-hydroxybenzoate, benzyl p-hydroxybenzoate, p-hydroxybenzoate-p-chlorobenzyl, p-hydroxybenzoate-o-chlorobenzyl, p-hydroxybenzoate-p-methylbenzyl, p-hydroxybenzoate-n-octyl, benzoic acid, zinc salicylate, 1-hydroxy-2-naphthoic acid, 2-hydroxy-6-naphthoic acid, 2-hydroxy-6-zinc naphthoate, 4-hydroxy diphenyl sulphone, 4-hydroxy-4'-chloro diphenyl sulfone, bis (4-hydroxy phenyl) sulfide, 2-hydroxy-p-toluic acid, 3, 5-di-tert-zinc butyl salicylate, 3,5-di-tert-tin butyl salicylate, tartaric acid, oxalic acid, maleic acid, citric acid, succinic acid, stearic acid, 4-hydroxyphthalic acid, boric acid, thiourea derivatives, 4-hydroxy thiophenol derivatives, bis (4-hydroxyphenyl) acetate, bis (4-hydroxyphenyl) ethyl acetate, bis (4-hydroxyphenyl) acetate-n-propyl, bis (4-hydroxyphenyl) acetate-n-butyl, bis (4-hydroxyphenyl) phenyl acetate, bis (4-hydroxyphenyl) benzyl acetate, bis (4-hydroxyphenyl) phenethyl acetate, bis (3-methyl-4-hydroxyphenyl) acetate, bis (3-methyl-4-hydroxyphenyl) methyl acetate, bis (3-methyl-4-hydroxyphenyl) acetate-n-propyl, 1,7-bis (4-hydroxyphenylthio) 3,5-dioxaheptane, 1,5-bis (4-hydroxyphenylthio) 3-oxaheptane, 4-hydroxy phthalate dimethyl, 4-hydroxy-4'-methoxy diphenyl sulfone, 4-hydroxy-4'-ethoxy diphenyl sulfone, 4-hydroxy-4'-isopropoxy diphenyl sulfone, 4-hydroxy-4'-propoxy diphenyl sulfone, 4-hydroxy-4'-butoxy diphenyl sulfone, 4-hydroxy-4'-isopropoxy diphenyl sulfone, 4-hydroxy-4'-sec-butoxy diphenyl sulfone, 4-hydroxy-4'-tert-butoxy diphenyl sulfone, 4-hydroxy-4'-benzyloxy diphenyl sulfone, 4-hydroxy-4'-phenoxy diphenyl sulfone, 4-hydroxy-4'-(m-methyl benzoxy) diphenyl sulfone, 4-hydroxy-4'-(p-methyl benzoxy) diphenyl sulfone, 4-hydroxy-4'-(o-methyl benzoxy) diphenyl sulfone, 4-hydroxy-4'-(p-chloro benzoxy) diphenyl sulfone, 4-hydroxy-4'-oxyaryl diphenyl sulfone, 4-hydroxy-4-allyloxy diphenyl sulfone, N-(2-[(phenylcarbamoyl) amino) phenyl) benzene sulfonamide, 4,4'-sulfonylbisphenol, polymer with 1,1'-oxybis[2-chloroethane], 2-(4-Hydroxyphenylsulfonyl)phenol, (Bis(3-allyl-4-hydroxyphenyl)sulfone). These may be used alone or in combination.

In the thermosensitive coloring layer, the mixing ratio of the developer to the leuco dye is such that the developer is preferably 0.5 parts by mass to 10 parts by mass, more preferably 1 part by mass to 5 parts by mass, relative to 1 part by mass of the leuco dye.

Besides the above-described leuco dye and developer, it is possible to appropriately add, to the thermosensitive coloring layer, other materials customarily used in thermosensitive recording materials, such as a binder, a filler, a hot-meltable material, a crosslinking agent, a pigment, a surfactant, a fluorescent whitening agent and a lubricant.

The binder may be used if necessary in order to improve the adhesiveness and coatability of the layer. The binder is suitably selected depending on the intended purpose without any restriction. Specific examples of the binder resin include starches, hydroxyethyl cellulose, methyl cellulose, carboxy methyl cellulose, gelatin, casein, gum arabic, polyvinyl alcohols, salts of diisobutylene-maleic anhydride copolymers, salts of styrene-maleic anhydride copolymers, salts of ethylene-acrylic acid copolymers, salts of styrene-acryl copolymers and salt emulsions of styrene-butadiene copolymers. Concerning these polymer binders, including for example polyvinyl alcohols, the same possible and appropriate variations in molecular constitution apply as discussed above for the undercoat layer(s) or as will be discussed below for the protective layer(s).

The filler is suitably selected depending on the intended purpose without any restriction. Examples thereof include inorganic pigments such as calcium carbonate, aluminum oxide, zinc oxide, titanium dioxide, silica, aluminum hydroxide, barium sulfate, talc, kaolin, alumina and clay, and commonly known organic pigments. Among these, acidic pigments (those which exhibit acidity in aqueous solutions) such as silica, alumina and kaolin are preferable, with silica being particularly preferable from the viewpoint of developed color density.

The hot-meltable material is suitably selected depending on the intended purpose without any restriction. Examples thereof include fatty acids such as stearic acid and behenic acid; fatty acid amides such as stearic acid amide, erucic acid amide, palmitic acid amide, behenic acid amide and palmitic acid amide; N-substituted amides such as N-lauryl lauric acid amide, N-stearyl stearic acid amide and N-oleyl stearic acid amid; bis fatty acid amides such as methylene bis stearic acid amide, ethylene bis stearic acid amide, ethylene bis lauric acid amide, ethylene bis capric acid amide and ethylene bis behenic acid amide; hydroxyl fatty acid amides such as hydroxyl stearic acid amide, methylene bis hydroxyl stearic acid amide, ethylene bis hydroxyl stearic acid amide and hexamethylene bis hydroxy stearic acid amide; metal salts of fatty acids, such as zinc stearate, aluminum stearate, calcium stearate, zinc palmitate and zinc behenate; p-benzyl biphenyl, terphenyl, triphenyl methane, benzyl p-benzyloxybenzoate, [beta]-benzyloxy naphthalene, phenyl [beta]-naphthoate, 1-hydroxy-2-phenyl naphthoate, methyl 1-hydroxy-2-naphthoate, diphenyl carbonate, benzyl terephthalate, 1,4-dimethoxy naphthalene, 1,4-diethoxy naphthalene, 1,4-dibenzyloxy naphthalene, 1,2-diphenoxy ethane, 1,2-bis (4-methyl phenoxy ethane), 1,4-diphenoxy-2-butene, 1,2-bis (4-methoxy phenyl thio) ethane, dibenzoyl methane, 1,4-diphenylthio butane, 1,4-diphenylthio-2-butene, 1,3-bis (2-vinyloxy ethoxy) benzene, 1,4-bis (2-vinyloxy ethoxy) benzene, p-(2-vinyloxy ethoxy) biphenyl, p-aryloxy biphenyl, dibenzoyloxymethane, di benzoyloxypropane, dibenzyl sulfide, 1,1-diphenyl ethanol, 1,1-diphenyl propanol, p-benzyloxy benzyl alcohol, 1,3-phenoxy-2-propanol, N-octadecyl carbamoyl-p-methoxy carbonyl benzene, N-octadecyl carbamoyl benzene, 1,2-bis (4-methoxyphenoxy) propane, 1,5-bis (4-methoxyphenoxy)-3-oxapentane, dibenzyl oxalate, bis (4-methyl benzyl) oxalate and bis (4-chlorobenzyl) oxalate. These may be used alone or in combination.

Further, it is preferred that diacetone-modified polyvinyl alcohol be incorporated into the thermosensitive coloring layer, when aminopolyamide-epichlorohydrin resin or similar species serving as a crosslinking agent is/are added to the thermosensitive coloring layer and the protective layer, a crosslinking reaction readily occurs, and water resistance can be improved without adding another crosslinking agent that could impede color development. Other applicable crosslinking species, notably for polyvinyl alcohol, are detailed in the following section concerning protective layer (s).

The thermosensitive coloring layer can be formed by commonly known methods. To avoid reaction between components of the thermosensitive coloring layer, in preferred embodiments, dispersion is carried out separately and then liquids are mixed. Grinding with a binder and other components is performed typically so as to have a particle diameter of 0.2 μm to 3 μm, preferably 0.2 μm to 1 μm by using a disperser such as a ball mill, an Atriter or a sand mill. The resultant dispersion is mixed, if necessary, together with a filler and a hot-meltable material (sensitizer) dispersion liquid in accordance with a predetermined formulation, to thereby prepare a coating liquid of a thermosensitive coloring layer, followed by applying the thus-prepared coating liquid onto a support.

The thickness of the thermosensitive coloring layer varies depending on the composition of the thermosensitive coloring layer and intended use of the thermosensitive recording materials and cannot be specified flatly, but it is preferably 1 μm to 50 μm, more preferably 2 μm to 20 μm.

Protective Layer(s)

The protective layer(s) contain(s) at least a water-soluble resin and/or an aqueous emulsion, and each of the protective layer(s) may contain an inorganic filler, a lubricant, and optionally a fluorescent whitening agent.

The water-soluble resin of (each of) the protective layer(s) is suitably selected depending on the intended purpose without any restriction, it being possible to use the same water-soluble resin in each protective layer of different water-soluble resin in separate protective layers. Examples thereof include polyvinyl alcohol, modified polyvinyl alcohol, starch and derivatives thereof, cellulose derivatives, poly(meth)acrylate and alkali salts thereof, poly(meth)acrylamide and alkali salts thereof, (meth)acrylamide copolymers and alkali salts thereof, alkali salts of styrene-maleic anhydride copolymers, polyvinylpyrrolidone, polyethyleneimine, alginate soda, gelatin and casein. Concerning these polymer binders, including for example polyvinyl alcohols, the same possible and appropriate variations in molecular constitution apply as discussed above for the undercoat layer(s). An aqueous emulsion resin may also be used. Examples thereof include emulsions of, for example, acryl copolymers, acrylic acid copolymers, (meth)acrylate copolymers, urethane resins, epoxy resins, vinyl acetate (co)polymers, vinylidene chloride (co)polymers, vinyl chloride (co)polymers; latexes of, for example, styrene-butadiene copolymers, and styrene-butadiene-acryl copolymers.

In the present invention, "polyvinyl alcohol" (used in any of the layers of a thermal recording material) is taken to encompass modified polyvinyl alcohols as commonly used by persons skilled in the art. Polyvinyl alcohol is often prepared industrially by polymerisation of vinyl acetate followed by saponification, so that a certain percentage of (—$CH_2$—CH[O—CO—Me]—) groups are present, in addition to the main monomer residue of (—$CH_2$—CH[OH]—). In typical commercially available polyvinyl alcohols, and which can appropriately be used in the practice of the present invention, the saponification range is normally from 70% to 99%, i.e. the polymer chain contains 70% to 99% of (—$CH_2$—CH[OH]—) units. In the context of the present invention, it is possible to use polyvinyl alcohol products which result from copolymerization of vinyl acetate with other monomers, such as itaconic acid, which gives rise to (—$CH_2$—C($CO_2$M)($CH_2CO_2$M)-) monomer residues in the polymer chain (M=H or a metal ion such as Na according to the pH/degree of neutralization). Other modified PVAs that can be used in the present invention include sulfonic modified PVAs, diacetonic modified PVAs, and acetoacetyl modified PVAs. PVAs may also contain residues from non-functionalized olefin monomers, unsaturated carboxylic acids other than itaconic acid ((meth)acrylic acid, maleic acid etc.), (meth)acrylamide, or acrylonitrile. Preferably, the PVA polymer contains a mole % of monomer residues not corresponding to vinyl alcohol or derivatives thereof (esters, acetals etc.) of at most 20 mol %, preferably at most 10 mol %. Typically appropriate degrees of polymerization of the polyvinyl alcohol are between 400 and 2000, i.e. there are between 400 and 2000 monomer units in the polymer chain on average. As explained above, for a perfect PVA homopolymer, all such monomer units would be (—$CH_2$—CHOH—). However, typically PVA materials sold commercially and used by persons skilled in the art contain a certain degree of residual ester groups and/or other main chain or side-chain modifications as discussed above.

In a preferred embodiment, polyvinyl alcohols modified using a crosslinking agent may be used in one or more of the protective layers. The crosslinking agent is suitably selected depending on the intended purpose without any restriction. Examples thereof include polyvalent amine compounds such as ethylene diamine; polyvalent aldehyde compounds such as glyoxal, glutalaldehyde and dialdehyde; dihydrazide compounds such as dihydrazide adipate and dihydrazide phthalate; polyamide-epichlorohydrin compounds; water-soluble methylol compounds (urea, melamine and phenol); multifunctional epoxy compounds; multivalent metal salts (e.g., Al, Ti, Zr and Mg); titanium lactate; and boric acid. The amount of the crosslinking agent varies depending on the amounts and types of functional groups of the crosslinking agent, but it is preferably 0.1 parts by mass to 100 parts by mass, more preferably 1 part by mass to 100 parts by mass, relative to 100 parts by mass of the binder resin.

In one preferred embodiment of the invention, polyvinyl alcohol with a crosslinking agent is used only in the outermost protective layer (furthest removed from the thermosensitive coloring layer), the underlying protective layer or layers not containing crosslinking agent. For example, a first protective layer containing polyvinyl alcohol as water-soluble resin, without crosslinking agent, may be coated on the thermosensitive coloring layer, followed by a second and final protective layer containing polyvinyl alcohol with a crosslinking agent. Alternatively, a first protective layer and a second protective layer, both containing polyvinyl alcohol as water-soluble resin, without crosslinking agent, may be coated on the thermosensitive coloring layer, followed by a third and final protective layer containing polyvinyl alcohol with a crosslinking agent. In another preferred embodiment, by contrast, the first overcoat layer applied to the thermosensitive coloring layer contains the largest amount of crosslinking agent, the top layer is substantially free of free of crosslinking agent and if there is a second overcoat layer between the top layer (third overcoat later) and the first overcoat layer, this contains a reduced amount of crosslinking agent as compared to the first overcoat layer.

The inorganic filler, if used, is suitably selected depending on the intended purpose without any restriction. Examples the inorganic filler include aluminum hydroxide, calcium carbonate, aluminum oxide, zinc oxide, titanium dioxide, silica, barium sulfate, talc, kaolin, alumina and clay. These may be used alone or in combination. Among these, aluminum hydroxide, and calcium carbonate are particularly preferable because the protective layer containing such inorganic filler is provided with excellent abrasion resistance with respect to a thermal head when printing is performed for a long period of time. The amount of the inorganic filler in the second protective layer is suitably selected depending on the intended purpose without any restriction. The amount of the inorganic filler depends on types of the filler, but it is preferably 50 parts by mass to 500 parts by mass, relative to 100 parts by mass of the binder resin.

The lubricant, if used, is suitably selected depending on the intended purpose without any restriction. Examples thereof include higher fatty acids such as zinc stearate, calcium stearate, montanate wax, polyethylene wax, carnauba wax, paraffin wax, ester wax and metal salts thereof; higher fatty acid amides, higher fatty acid esters, animal wax, vegetable wax, mineral wax, and petroleum wax.

A fluorescent whitening agent may be added to improve light resistance and improve background whiteness. Such a fluorescent whitening agent may be added to all protective layers or just some of them. In one preferred embodiment, there is a first protective layer containing the water-soluble resin and the fluorescent whitening agent, and a second protective layer containing the water-soluble resin but no fluorescent whitening agent, formed in this order over the thermosensitive coloring layer. In this case, even though the amount of the fluorescent whitening agent is increased in the entire protective layer, background whiteness can be maintained while the background is prevented from being turned yellow. Moreover, it can be expected to further improve the light resistance due to the fluorescent whitening agent, as well as improving the water resistance.

If used, the fluorescent whitening agent is suitably selected depending on the intended purpose without any restriction. A stilbene compound is preferable from the standpoint of exhibiting excellent light resistance. Examples of suitable stilbene compounds are given in EP 2 716 466 and EP 2 722 190.

A method for forming the first, second or subsequent protective layer is suitably selected depending on the intended purpose without any restriction. Examples thereof include blade coating, roll coating, wire bar coating, die coating, and curtain coating.

Other Layers

The thermosensitive recording material may appropriately contain a back layer containing a pigment, a water-soluble resin (binder resin) and a crosslinking agent, disposed on the surface of the support opposite to the surface thereof where the undercoat layer is disposed.

The back layer may further contain other components such as a filler, a lubricant, an antistatic agent, and the like.

As for the binder resin, either of a water-dispersible resin or a water-soluble resin is used. Specific examples thereof include conventionally known water-soluble polymers, and aqueous polymer emulsions.

The water-soluble polymer is suitably selected depending on the intended purpose without any restriction. Examples thereof include polyvinyl alcohol, starch and derivatives thereof, cellulose derivatives such as methoxy cellulose, hydroxy ethyl cellulose, carboxy methyl cellulose, methyl cellulose and ethyl cellulose, polyacrylate soda, polyvinyl pyrrolidone, acryl amide-acrylate copolymers, acryl amide-acrylate-methacrylic acid terpolymers, alkali salts of styrene-maleic anhydride copolymers, alkali salts of isobutylene-maleic anhydride copolymers, polyacrylamide, alginate soda, gelatin and casein. These may be used alone or in combination.

The aqueous polymer emulsion is suitably selected depending on the intended purpose without any restriction. Examples thereof include latexes of, for example, acrylate copolymers, styrene-butadiene copolymers and styrene-butadiene-acryl copolymers; and emulsions of, for example, vinyl acetate resins, vinyl acetate-acrylate copolymers, styrene-acrylate copolymers, acrylate resins and polyurethane resins. These may be used alone or in combination.

As the crosslinking agent, the same crosslinking agent as those mentioned for possible used in the protective layer(s) may be used.

As the filler, either an inorganic filler or an organic filler may be used. Examples of the inorganic filler include carbonates, silicates, metal oxides and sulfate compounds. Examples of the organic filler include silicone resins, cellulose resins, epoxy resins, nylon resins, phenol resins, polyurethane resins, urea resins, melamine resins, polyester resins, polycarbonate resins, styrene resins, acrylic resins, polyethylene resins, formaldehyde resins and polymethyl methacrylate resins.

A method for forming the back layer is suitably selected depending on the intended purpose without any restriction. The back layer is preferably formed by applying a coating liquid of the back layer to a support.

The coating method is suitably selected depending on the intended purpose without any restriction. Examples thereof include blade coating, roll coating, wire bar coating, die coating, and curtain coating.

The thickness of the back layer is suitably selected depending on the intended purpose without any restriction. It is preferably 0.1 μm to 10 μm, more preferably 0.5 μm to 5 μm.

Image Recording Method

An image recording method of the present invention includes recording an image on the thermosensitive recording material of any of the embodiments of the present invention using an image recording unit, which is any one of a thermal head and a laser.

The thermal head is suitably selected depending on the intended purpose without any restriction regarding the shape, structure and size thereof.

The laser is suitably selected depending on the intended purpose without any restriction. In one preferred embodiment, a $CO_2$ laser which emits light having a wavelength of 9.3 μm to 10.6 μm may be used. By using the $CO_2$ laser which emits light having a wavelength of 9.3 μm to 10.6 μm, a satisfactory laser print image can be obtained without using a photothermal conversion agent such as a phthalocyanine pigment. Other laser types may be used, such as FLDA (Fiber Laser Diode Array).

EXAMPLES

Hereinafter, the present invention will be specifically described based on Examples and Comparative Examples. However, it should be noted that the present invention is not confined to these Examples in any way. It should be noted that in the following examples, the unit "part(s) means "part(s) by mass" and the unit "%" means "% by mass" unless otherwise specified.

Examples 1 to 13 and Comparative Examples 1 to 4

In this first set of samples, the effect of the addition in a protective layer or in thermosensitive layer of MGDA and GLDA chelating agents on plasticizer face resistance was measured.

A base paper support (wood-free paper having a basis weight of 60 g/m$^2$) was provided. Thermal recording media were obtained by successive deposition on a base paper support (wood-free paper with a basis weight of 60 g/m$^2$) of undercoat liquid, thermal coat liquid and protective layer coating liquid. For each coating liquid deposition, application was carried out uniformly with a wire bar coating and a layer formed with air drying.

To prepare the undercoat, the following composition was prepared:

[Liquid A—Undercoat Layer—Coating Liquid]

50% Styrene-butadiene copolymer latex: 13.7 parts

33% R-500 Hollow particles: 13.9 parts

10% polyvinyl alcohol aqueous solution: 15.6 parts

Water: 56.8 parts

The commercial supplier of R-500 plastic spherical hollow particles was Matsumoto Yushi-Seiyaku Co., Ltd. These materials were mixed and stirred to prepare a coating liquid of an undercoat layer [liquid A]. The coating liquid of the undercoat layer [liquid A] was uniformly applied to the surface of the base paper support so has to have a deposition amount of 2.0 g/m$^2$ on a dry basis, and then dried, to thereby form an undercoat layer.

With regard to the preparation of a coating liquid of a thermosensitive coloring layer, the following compositions were prepared:

[Liquid B—Dye Dispersion Liquid]

2-anilino-3-methyl-6-(di-n-butylamino)fluoran: 20 parts

10% itaconic-modifled polyvinyl alcohol aqueous solution: 20 parts

Water: 60 parts

[Liquid C Colour-Developing Dispersion]

4-hydroxy-4'-allyloxydiphenylsulfone: 20 parts

10% itaconic-modified polyvinyl alcohol aqueous solution: 20 parts

Silica: 10 parts

Water: 50 parts

[Liquid B] and [Liquid C] having the aforementioned compositions respectively, were each dispersed using a sand mill, so that particles contained in each liquid had an average particle diameter of 1.0 μm or less, to thereby prepare a dye dispersion liquid [Liquid B] and a developer dispersion liquid [Liquid C]. Then, [Liquid B] and [Liquid C] were mixed in the ratio of 1/4, and water added so as to adjust the solid content to 20%, followed by stirring, to thereby prepare a coating liquid of a thermosensitive coloring layer [Liquid D].

With regard to the preparation of a coating liquid of a protective layer, the following [Liquid E] was prepared:

30% Dispersion liquid of Aluminium hydroxide 17 parts

10% itaconic acid-modified polyvinyl alcohol aqueous solution: 33 parts

20% Aminopolyamide-epichlorohydrin resin 17 parts

Montanate Wax 1 parts

Water 32 parts

In Examples 1 to 13 and Comparative Examples 1 to 4 some chelating agents were added (or not) into thermosensitive liquid [D] or protective layer liquid [E]. The obtained thermosensitive liquids [liquid D] or [Liquid D+chelating] were uniformly applied to the undercoat layer to thereby form a thermosensitive coloring layer. The coating amount of the thermal layer was such as to produce a dye coating weight of 0.5 g/m$^2$ on a dry basis, where all chemicals except chelating agent amount is 3.5 g/m$^2$ on a dry basis.

In the same way, obtained protective layer liquids were applied on the top of the thermosensitive layer in order to get a deposition amount of 2.0 g/m$^2$ of all chemicals except chelating agent. By this means, the only differences between all samples are the chelating agent type, the coating liquid in which chelating agent was added and the chelating agent coating weight while all other chemicals remain in exactly the same quantity.

The type of chelating agent, the coating liquid in which addition was made and the coating weight on a dry basis of chelating agent, for thermosensitive and protective layers are indicated in Table 1.

TABLE 1

| | Chelating agent type | Coating liquid in which chelating agent has been added | Amount (mass parts for 100 parts of coating liquid [D] or [E] | Chelating agent dry Coating weight | Coating weight of thermosensitive layer on dry basis | Coating weight of protective layer on dry basis |
|---|---|---|---|---|---|---|
| Ex-1 | MGDA-$Na_3$ | Liquid [D] | 0.28 | 0.05 | 3.55 | 2.0 |
| Ex-2 | MGDA-$Na_3$ | Liquid [D] | 0.86 | 0.15 | 3.65 | 2.0 |
| Ex-3 | MGDA-$Na_3$ | Liquid [D] | 1.71 | 0.3 | 3.80 | 2.0 |
| Ex-4 | GLDA-$Na_4$ | Liquid [D] | 1.74 | 0.15 | 3.65 | 2.0 |
| Ex-5 | MGDA-$Na_3$ | Liquid [E] | 0.3 | 0.05 | 3.5 | 2.05 |
| Ex-6 | MGDA-$Na_3$ | Liquid [E] | 0.9 | 0.15 | 3.5 | 2.15 |
| Ex-7 | MGDA-$Na_3$ | Liquid [E] | 1.8 | 0.3 | 3.5 | 2.30 |
| Ex-8 | GLDA-$Na_4$ | Liquid [E] | 1.84 | 0.15 | 3.5 | 2.15 |
| Ex-9 | ATMP-$Na_5$ | Liquid [D] | 1.90 | 0.15 | 3.65 | 2.0 |
| Ex-10 | STPP | Liquid [D] | 0.86 | 0.15 | 3.65 | 2.0 |
| Ex-11 | ATMP-$Na_5$ | Liquid [E] | 2.0 | 0.15 | 3.5 | 2.15 |
| Ex-12 | $Na_3PO_4$ | Liquid [E] | 0.9 | 0.15 | 3.5 | 2.15 |
| Ex-13 | STPP | Liquid [E] | 0.9 | 0.15 | 3.5 | 2.15 |
| Comp Ex 1 | EDTA-$Na_4$ | Liquid [D] | 2.14 | 0.15 | 3.65 | 2.0 |
| Comp Ex 2 | IDS | Liquid [D] | 2.52 | 0.15 | 3.65 | 2.0 |
| Comp Ex 3 | EDTA-$Na_4$ | Liquid [E] | 2.25 | 0.15 | 3.5 | 2.15 |
| Comp Ex 4 | No | No | No | No | 3.5 | 2.0 |

The commercial grade of chelating agent which were used are detailed in Table 2.

TABLE 2

| | Chelating agent type | Commercial grade | Supplier | Solid content |
|---|---|---|---|---|
| MGDA-$Na_3$ | MethylGlycineDiacetic Acid sodium salt | Trilon M granules SG | BASF | 100% |
| GLDA-$Na_4$ | Glutamic acid, N,N-diacetic acid sodium salt | Dissolvine GL-38 | AKZO NOBEL | 49% |
| EDTA-$Na_4$ | Ethylenediaminetetraacetic acid sodium salt | Trilon B Liquid | BASF | 40% |
| ATMP-$Na_5$ | Amino trimethylene phosphonic acid sodium salt | Dequest 2006 | ITALMATCH | 45% |
| STPP ($Na_5P_3O_{10}$) | Sodium Tripolyphosphate | Polypray H | PRAYON | 100% |
| IDS | Iminodisuccinic acid sodium salt | Baypure CX100 | LANXESS | 34% |
| $Na_3PO_4$ | Trisodiumphosphate | Prayphos TSP FG | PRAYON | 100% |

The multilayered product was kept at 40° C. during 15 hours and then calandered to produce a surface Bekk smoothness of 3000.

<Test of Plasticizer Resistance Long Term>

To evaluate plasticizer resistance, a first black pattern, called dynamic, was printed with a Tec B-SA4T equipment from Toshiba (300 dpi), and a second one was printed with a heat-gradient tester manufactured by Toyo Seiki Seisakusho, Ltd. (temperature 160° C., time: 0.5 sec, pressure 3.6 kgf/$cm^2$).

Printing density of pre-test image was measured using the X-Rite Exact densitometer (an average of three measurements is determined). Subsequently, two sheets of polyvinyl chloride wrapping film (produced by Shin-Etsu Polymer Co., Ltd.) were laid over the samples, and the sample was left to stand 3 days at 40° C. under a load of 5 kg. Then the image density was measured on three points using the X-Rite Exact densitometer and the average recorded so as to evaluate the plasticizer resistance of the sample. Remaining ratio was calculated by dividing image density measured after test by image density measured before test.

Using the thermal recording materials of Examples 1 to 13 and Comparative Examples 1 to 4, the following results were obtained:

TABLE 3

| | Before | | After | | Remaining ratio | |
|---|---|---|---|---|---|---|
| | Dynamic | Static | Dynamic | Static | Dynamic | Static |
| Ex-1 | 1.36 | 1.34 | 0.83 | 0.75 | 0.61 | 0.56 |
| Ex-2 | 1.34 | 1.28 | 0.86 | 0.82 | 0.64 | 0.64 |
| Ex-3 | 1.37 | 1.35 | 1.34 | 1.09 | 0.98 | 0.81 |
| Ex-4 | 1.36 | 1.33 | 0.90 | 0.85 | 0.66 | 0.64 |
| Ex-5 | 1.31 | 1.28 | 0.79 | 0.74 | 0.61 | 0.58 |
| Ex-6 | 1.35 | 1.29 | 0.84 | 0.79 | 0.62 | 0.61 |
| Ex-7 | 1.35 | 1.38 | 1.17 | 0.98 | 0.87 | 0.71 |
| Ex-8 | 1.37 | 1.40 | 1.10 | 1.12 | 0.81 | 0.80 |
| Ex-9 | 1.37 | 1.34 | 0.81 | 0.73 | 0.59 | 0.55 |
| Ex-10 | 1.35 | 1.33 | 0.78 | 0.69 | 0.58 | 0.52 |
| Ex-11 | 1.33 | 1.31 | 0.79 | 0.68 | 0.59 | 0.52 |
| Ex-12 | 1.36 | 1.38 | 0.78 | 0.73 | 0.57 | 0.53 |
| Ex-13 | 1.35 | 1.36 | 0.80 | 0.68 | 0.59 | 0.50 |

TABLE 3-continued

| | Before | | After | | Remaining ratio | |
|---|---|---|---|---|---|---|
| | Dynamic | Static | Dynamic | Static | Dynamic | Static |
| Comp Ex 1 | 1.36 | 1.33 | 0.75 | 0.61 | 0.55 | 0.46 |
| Comp Ex 2 | 1.36 | 1.33 | 0.52 | 0.51 | 0.38 | 0.39 |
| Comp Ex 3 | 1.33 | 1.29 | 0.76 | 0.65 | 0.57 | 0.50 |
| Comp Ex 4 | 1.37 | 1.33 | 0.73 | 0.55 | 0.53 | 0.42 |

The results of Table 3 reveal that the thermosensitive recording papers which contain a chelating agent type MGDA-$Na_3$ and GLDA-$Na_4$ added either in thermosensitive layer or protective layer as in Examples 1 to 8, were superior to Comparative Examples in which no chelating agent or another type of chelating agents was added.

In this evaluation, improvement of plasticizer face resistance is increased in proportion to the quantity of MGDA or GLDA initially added.

Examples 14 to 17 and Comparative Examples 5 to 6

In the second set of examples, the effect of the addition of MGDA and GLDA was evaluated considering another type of protective layer, containing a crosslinker.

For the preparation of a coating liquid of this other type of protective layer, following [liquid F] was prepared:

20% dispersion liquid of kaolin: 30 parts

10% polyvinyl alcohol aqueous solution: 36.4 parts

10% adipic acid dihydrazine solution: 3.6 parts

Water: 30 parts

The second set of samples was obtained in the same manner as the first set of samples, except that the different types of chelating agent were added to liquid [F] and, after stirring, uniformly applied on top of the thermosensitive layer in order to get a deposition amount of 2.0 g/$m^2$ of all chemicals except chelating agent and a chelating agent deposition as mentioned in Table 4.

TABLE 4

| | Chelating agent type | Coating liquid in which chelating agent has been added | Amount (mass parts for 100 parts of [liquid F]) | Chelating agent dry Coating weight | Total Coating weight of protective layer on dry basis (chelating agent included) |
|---|---|---|---|---|---|
| Ex-14 | MGDA-$Na_3$ | Liquid [F] | 0.75 | 0.15 | 2.15 |
| Ex-15 | GLDA-$Na_4$ | Liquid [F] | 0.50 | 0.05 | 2.05 |
| Ex-16 | GLDA-$Na_4$ | Liquid [F] | 1.53 | 0.15 | 2.15 |
| Ex-17 | GLDA-$Na_4$ | Liquid [F] | 3.06 | 0.3 | 2.3 |
| Comp Ex 5 | EDTA-$Na_4$ | Liquid [F] | 1.87 | 0.15 | 2.0 |
| Comp Ex 6 | No | No | 0 | 0 | 2.0 |

<Test of Plasticizer Resistance>

Due to lower plasticizer resistance of this type of protective layer, a less harsh method than for the first set was applied. In this method, samples were printed and evaluated in same manner as for the long term test explained above, but left to stand only 15 hours at 40° C.

Using the thermal recording materials of Examples 14 to 17 and Comparative Examples 5 and 6 the following results were obtained:

TABLE 5

| | Before | | After | | Remaining ratio | |
|---|---|---|---|---|---|---|
| | Dynamic | Static | Dynamic | Static | Dynamic | Static |
| Ex-14 | 1.39 | 1.43 | 0.16 | 0.52 | 0.11 | 0.36 |
| Ex-15 | 1.35 | 1.35 | 0.17 | 0.67 | 0.12 | 0.49 |
| Ex-16 | 1.39 | 1.43 | 0.17 | 0.86 | 0.12 | 0.60 |
| Ex-17 | 1.34 | 1.39 | 0.16 | 1.12 | 0.12 | 0.81 |
| Comp Ex 5 | 1.34 | 1.41 | 0.15 | 0.48 | 0.11 | 0.34 |
| Comp Ex 6 | 1.36 | 1.40 | 0.15 | 0.22 | 0.11 | 0.16 |

The results of Table 5 revealed that even in a totally different type of protective layer, MGDA and GLDA chelating agent used in Example 14 to 17 were superior in plasticizer resistance to Comparative Examples 5 and 6, which did not contain any chelating agent or contained EDTA.

Examples 18 to 26 and Comparative Examples 7 to 11

In a third set of examples, the effect of addition in an undercoat layer of different types of chelating agents was evaluated.

The third set of samples was obtained in the same manner as first set of samples, except that the different types of chelating agent were added to liquid [A] and applied to the surface of the base paper so as to have a deposition amount of 2.0 g/$m^2$ on a dry basis of all chemicals except chelating agent, with a chelating agent deposition as mentioned in Table 6 before application of same thermosensitive and protective layer as in the first set. In Example 24, combination of two different chelating agents was evaluated. MGDA was incorporated in an under-layer in order to reach a final deposition amount of 0.15 g/$m^2$ while ATMP was incorporated in the thermal layer in order to reach a deposition amount of 0.15 g/$m^2$.

TABLE 6

| | Chelating agent type | Coating liquid in which chelating agent has been added | Amount (mass parts for 100 parts of [liquid A] or [D] | Chelating agent dry Coating weight | Total Coating weight of under on dry basis (chelating agent included) |
|---|---|---|---|---|---|
| Ex-18 | MGDA-$Na_3$ | Liquid [A] | 0.97 | 0.15 | 2.15 |
| Ex-19 | MGDA-$Na_3$ | Liquid [A] | 1.94 | 0.3 | 2.3 |
| Ex-20 | GLDA-$Na_4$ | Liquid [A] | 1.98 | 0.15 | 2.15 |
| Ex-21 | EDTA-$Na_4$ | Liquid [A] | 2.43 | 0.15 | 2.15 |
| Ex-22 | HEDTA-$Na_3$ | Liquid [A] | 1.95 | 0.15 | 2.15 |
| Ex-23 | DTPA-$Na_5$ | Liquid [A] | 2.03 | 0.15 | 2.15 |
| Ex-24 | MGDA + ATMP | Liquid [A] + [D] | 0.97/1.90 | 0.15 + 0.15 | 2.15 |
| Ex-25 | ATMP-$Na_5$ | Liquid [A] | 2.16 | 0.15 | 2.15 |
| Ex-26 | STPP | Liquid [A] | 0.97 | 0.15 | 2.15 |
| Comp Ex 7 | EDDS | Liquid [A] | 2.43 | 0.15 | 2.15 |
| Comp Ex 8 | IDS | Liquid [A] | 2.86 | 0.15 | 2.15 |
| Comp Ex 9 | Maleic multipolymer | Liquid [A] | 1.95 | 0.15 | 2.15 |
| Comp Ex 10 | PAA/SA/SS | Liquid [A] | 0.7 | 0.15 | 2.15 |
| Comp Ex 11 | No | Liquid [A] | No | No | 2.0 |

Commercial grades of MGDA-$Na_3$, GLDA-$Na_4$, EDTA-$Na_4$, ATMP-$Na_5$, STPP, IDS, were the same as the ones detailed for Table 2.

Additionally, the following chelating agents were used:

HEDTA-$Na_3$ (Hydroxyethyethylenediaminatriacetic acid sodium salt): grade used was Dissolvine H-40 manufactured by AKZO NOBEL (solid content=50%)

DTPA-$Na_5$ (diethylenetriaminepentaacetic acid sodium salt): grade used was Versenex80E manufactured by DOW (solid content=48%)

EDDS (Ethylenediamine-N,N'-disuccinic acid): grade used was Enviomet C140 manufactured by INNOSPEC (solid content=40%)

Maleic multipolymer: grade used was Acumer 4300 manufactured by DOW (solid content=50%)

PAA/SA/SS (Acrylic Acid, Sulfonic acid, Sulfonated Styrene copolymer): grade used was Carbospere K-797 manufactured by LUBRIZOL (solid content=100%)

As the same protective layer type was used as for the first set of examples, the same method was used also and plasticizer resistance was evaluated in the long term test (3 days at 40° C.).

<Test of Stearate Migration Resistance Long Term>

To evaluate Stearate Migration Resistance, a solution of zinc stearate (Hidrorin EZ-730 S manufactured by Chukyo Europe GmbH) was uniformly applied on a base paper support to thereby form after drying a zinc stearate layer having a coating weight of 10 g/$m^2$ on a dry basis. A 13*3.5 cm sheet of coated zinc-stearate layer was laid over a 5*5 cm sample of thermosensitive recording material and stored 64 hours at a temperature of 60° C. and a relative humidity of 95% under a load of 5 kg. After the migration step, zinc-stearate coated sample was removed and thermal recording material was pre-printed with Sicura flex 39-8 ink from Siegwerk using a Flexiproof 100 equipment manufactured by Erichsen (speed=50 m/mn, anilox=4 $cm^3$). Thereafter ink deposited on thermal recording material was cured under UV and left for 24 hours in normal room conditions for stabilisation.

Ink optical density was measured on three higher points and average was recorded. Higher value is preferred as decrease of density is relevant of a lack of ink deposit due to stearate migration The results obtained were shown in the following Table 7:

TABLE 7

| | Before | | After | | | | |
|---|---|---|---|---|---|---|---|
| | Dy- | | Dy- | | Remaining ratio | | Migration |
| | namic | Static | namic | Static | Dynamic | Static | test |
| Ex-18 | 1.30 | 1.35 | 1.01 | 1.16 | 0.78 | 0.86 | 0.80 |
| Ex-19 | 1.29 | 1.27 | 1.21 | 1.19 | 0.94 | 0.94 | 0.74 |
| Ex-20 | 1.33 | 1.31 | 1.05 | 1.17 | 0.79 | 0.90 | 0.85 |
| Ex-21 | 1.33 | 1.29 | 1.01 | 0.97 | 0.76 | 0.75 | 0.73 |
| Ex-22 | 1.31 | 1.30 | 0.99 | 1.12 | 0.76 | 0.86 | 0.56 |
| Ex-23 | 1.31 | 1.31 | 0.92 | 1.10 | 0.70 | 0.84 | 0.73 |
| Ex-24 | 1.30 | 1.28 | 1.03 | 1.11 | 0.79 | 0.87 | 1.05 |
| Ex-25 | 1.29 | 1.24 | 0.65 | 0.61 | 0.50 | 0.49 | 0.95 |
| Ex-26 | 1.30 | 1.32 | 0.62 | 0.65 | 0.48 | 0.49 | 0.95 |
| Comp Ex 7 | 1.29 | 1.24 | 0.47 | 0.49 | 0.36 | 0.39 | 0.70 |
| Comp Ex 8 | 1.32 | 1.29 | 0.68 | 0.31 | 0.52 | 0.24 | 0.8 |
| Comp Ex 9 | 1.33 | 1.32 | 0.25 | 0.32 | 0.19 | 0.24 | 0.76 |

TABLE 7-continued

| | Before | | After | | | | |
|---|---|---|---|---|---|---|---|
| | Dy- | | Dy- | | Remaining ratio | | Migration |
| | namic | Static | namic | Static | Dynamic | Static | test |
| Comp Ex 10 | 1.31 | 1.35 | 0.53 | 0.69 | 0.40 | 0.51 | 0.74 |
| Comp Ex 11 | 1.32 | 1.28 | 0.73 | 0.55 | 0.55 | 0.43 | 0.58 |

The results revealed that superior plasticizer resistance was obtained with chelating agents which were of the aminocarboxylate type (Examples 18 to 24) than with all other types of chelating agent tested or without chelating agent.

Among all aminocarboxylate samples, MGDA and GLDA (Ex-18 to 20) were distinguished by even superior plasticizer resistance as compared to others.

In Example 24, a combination of two types of chelating agent allows one to cumulate advantageous properties, e.g. superior plasticizer resistance and superior migration resistance.

Examples 25 to 26 which contains phosphorus based chelating agent appeared to be superior in term of migration test preprint uniformity.

Examples 27 to 39 and Comp Examples 12 to 14

In last set of samples, effect of phosphorus-based chelating agent added in one of the different layers of thermosensitive recording material on pre-print uniformity after stearate migration test has been evaluated.

This set of samples was obtained in the same manner as first set of samples, except that chelating agent were added either to [liquid A], or [liquid D] or [liquid E] and applied so as to have a deposition amount a deposition amount of [liquid A] of 2.0 g/$m^2$, [liquid D] of 3.5 g/$m^2$ and [liquid E] of 2.0 g/$m^2$, with a chelating agent deposition as mentioned in Table 8.

Example 36 was prepared in the same manner as Example 24 in order to obtain a combination of MGDA and ATMP chelating agents.

TABLE 8

| | Chelating agent type | Coating liquid in which chelating agent has been added | Amount (mass parts for 100 parts of coating liquid ([liquid A] or [D] or [E] | Chelating agent dry Coating weight |
|---|---|---|---|---|
| Ex-27 | ATMP-$Na_5$ | Liquid [A] | 2.16 | 0.15 |
| Ex-28 | EDTMP-$Na_5$ | Liquid [A] | 2.56 | 0.15 |
| Ex-29 | DTMP-$Na_7$ | Liquid [A] | 2.07 | 0.15 |
| Ex-30 | $Na_3PO_4$ | Liquid [A] | 0.97 | 0.15 |
| Ex-31 | STPP | Liquid [A] | 0.97 | 0.15 |
| Ex-32 | ATMP-$Na_5$ | Liquid [D] | 1.90 | 0.15 |
| Ex-33 | STPP | Liquid [D] | 0.90 | 0.15 |
| Ex-34 | ATMP-$Na_5$ | Liquid [E] | 2.0 | 0.15 |
| Ex-35 | STPP | Liquid [E] | 0.9 | 0.15 |
| Ex-36 | MGDA-$Na_3$ + ATMP-$Na_5$ | Liquid [A] + Liquid [D] | 0.97 + 1.9 | 0.15 + 0.15 |
| Ex-37 | MGDA-$Na_3$ | Liquid [A] | 0.97 | 0.15 |
| Ex-38 | EDTA-$Na_4$ | Liquid [A] | 2.43 | 0.15 |
| Ex-39 | HEDTA-$Na_3$ | Liquid [A] | 1.95 | 0.15 |
| Comp Ex 12 | Maleic multipolymer | Liquid [A] | 1.95 | 0.15 |
| Comp Ex 13 | PAA/SA/SS | Liquid [A] | 0.7 | 0.15 |
| Comp Ex 14 | No | No | 0 | 0 |

The commercial grades of ATMP-$Na_5$, $Na_3PO_4$, STPP, MGDA-$Na_3$, EDTA-$Na_4$, HEDTA-$Na_3$, Maleic multipolymer and PAA/SA/SS were the same as the ones detailed previously in Table 2 or/and in Table 6.

Additionally, the following chelating agents were used:

| Chelating agent type | | Commercial grade | Supplier | Solid content |
|---|---|---|---|---|
| EDTMP-$Na_5$ | Ethylenediamine tetra(methylene-phosphonic acid) sodium salt | Dequest 2046 | Italmatch | 38% |
| DTPMP-$Na_7$ | Diethylene triamine penta (methylene phosphonic acid) sodium salt | FS0536N | Italmatch | 47% |

In order to confirm effect of all samples on stearate migration resistance, an additional test was performed:

<Test of Stearate Migration Resistance Short Term>

The same method as for stearate migration resistance in the long term was applied but samples were left only 24 h at a temperature of 60° C. and a relative humidity of 95% under a load of 5 kg. After preprint, ink optical density was measured on the three lower points and average was recorded. A higher value is preferred as decrease of density is indicative of a lack of ink deposit due to stearate migration.

The two types of stearate migration test were performed (short & long term) and the following results were obtained:

TABLE 9

| | Short term | Long term |
|---|---|---|
| Ex-27 | 1.03 | 0.95 |
| Ex-28 | 1.05 | 0.92 |
| Ex-29 | 1.02 | 0.93 |
| Ex-30 | 1.06 | 0.92 |
| Ex-31 | 1.04 | 0.91 |
| Ex-32 | 1.04 | 0.95 |
| Ex-33 | 1.02 | 0.89 |
| Ex-34 | 1.02 | 1.02 |
| Ex-35 | 1.03 | 0.95 |
| Ex-36 | 1.05 | 1.02 |
| Ex-37 | 0.9 | 0.80 |
| Ex-38 | 0.96 | 0.73 |
| Ex-39 | 0.88 | 0.56 |
| Comp Ex 12 | 0.75 | 0.76 |
| Comp Ex 13 | 0.81 | 0.74 |
| Comp Ex 14 | 0.76 | 0.58 |

From this experiment table, the inventors determined that phosphorus-based chelating agent increases stearate migration resistance whatever the layer in which chelating agent was added. Addition of another type of chelating agent as in Example 36 makes possible cumulated advantageous effects.

The invention claimed is:

1. A thermal recording material comprising:

a base layer;

one or more undercoat layers which is/are laid down on the base layer;

a thermo-sensitive coloring layer which is laid down on the uppermost undercoat layer, on the opposite side with respect to the base layer; and one or more protective layers which is/are laid down on the thermo-sensitive coloring layer, on the opposite side with respect to the undercoat layer(s), wherein one or more of said protective layer(s) and/or said thermosensitive layer contains a chelating agent whose structure is given by following general formula (1):

(1)

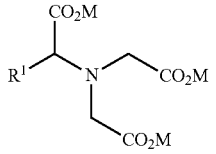

wherein R1 is a linear alkyl group of 1 to 8 carbon atoms, optionally substituted with one or more carboxyl groups —CO2M, wherein M is hydrogen, ammonium or substituted ammonium, alkali metal, alkaline earth metal or a combination thereof.

2. The thermal recording material according to claim 1, wherein the chelating agent is:

methylglycine diacetic acid (MGDA) or salts thereof, having R1=—CH3; or glutamic diacetic acid (GLDA) or salts thereof, having R1=—(CH2)2-CO2M, where M is defined as in claim 1.

3. The thermal recording material according to claim 1, wherein one or more of the said undercoat layer(s) and/or the thermo-sensitive coloring layer and/or one or more of the said protective layer(s) further contains a phosphorus-based chelating agent.

4. A thermal recording material according to claim 1, wherein the thermo-sensitive layer contains a leuco dye and a developer.

5. An image forming method including recording an image on the thermal recording material according to claim 1 using an image recording unit, which is any one of a thermal head and a laser.

6. A thermal recording material comprising:

a base layer;

one or more undercoat layers which is/are laid down on the base layer;

a thermo-sensitive coloring layer which is laid down on the uppermost undercoat layer, on the opposite side with respect to the base layer; and one or more protective layers which is/are laid down on the thermo-sensitive coloring layer, on the opposite side with respect to the undercoat layer(s), wherein one or more of the said undercoat layers contains an aminocarboxylic acid chelating agent.

7. The thermal recording material according to claim 6, wherein the aminocarboxylic acid chelating agent contains —N—CH2-CH2-N— groups and/or —N—CH2-CO2M groups, wherein in —CO2M, M is hydrogen, ammonium or substituted ammonium, alkali metal, alkaline earth metal or a combination thereof.

8. The thermal recording material according to claim 7, wherein the chelating agent whose structure is given by following general formula (1):

(1)

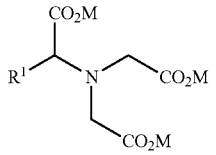

wherein R1 is a linear alkyl group of 1 to 8 carbon atoms, optionally substituted with one or more carboxyl groups —CO2M, wherein M is hydrogen, ammonium or substituted ammonium, alkali metal, alkaline earth metal or a combination thereof.

9. The thermal recording material according to claim 7, wherein the chelating agent is:

methylglycine diacetic acid (MGDA) or salts thereof; or glutamic diacetic acid (GLDA) or salts thereof.

10. The thermal recording material according to claim 7, wherein the chelating agent is:

ethylendiamine tetraacetic acid (EDTA) or salts thereof; or hydroxyethylendiamine triacetic acid (HEDTA) or salts thereof.

* * * * *